US005984577A

United States Patent [19]

Strong

[11] Patent Number: 5,984,577

[45] Date of Patent: Nov. 16, 1999

[54] FLOTATION FLOOD WALL

[76] Inventor: William P. Strong, 2244 Bard Ct., Cocoa, Fla. 32926

[21] Appl. No.: 09/094,643

[22] Filed: Jun. 15, 1998

Related U.S. Application Data

[60] Provisional application No. 60/050,148, Jun. 18, 1997.

[51] Int. Cl.[6] ..... E02B 7/20; E02B 7/50; E01F 7/00

[52] U.S. Cl. ..... 405/114; 405/16; 405/21; 405/91; 405/115; 405/52

[58] Field of Search ..... 405/21, 16, 114, 405/115, 91, 52, 63

[56] References Cited

U.S. PATENT DOCUMENTS

| | | | |
|---|---|---|---|
| 4,252,461 | 2/1981 | Colamussi et al. | 405/115 |
| 4,555,201 | 11/1985 | Paoluccio | 405/21 X |
| 4,958,956 | 9/1990 | Tanaka et al. | 405/21 X |
| 5,125,767 | 6/1992 | Dooleage | 405/21 X |
| 5,158,395 | 10/1992 | Holmberg | 405/21 |
| 5,197,821 | 3/1993 | Cain et al. | 405/63 X |
| 5,310,283 | 5/1994 | Berg | 405/63 X |
| 5,645,373 | 7/1997 | Jenkins | 405/114 X |
| 5,865,564 | 2/1999 | Miller et al. | 405/21 X |

*Primary Examiner*—Dennis L. Taylor

[57] ABSTRACT

A flood barrier wall consisting of a flexible tubular flood chamber, skirts and an air-filled flotation collar. In its unexpanded and deflated mode the device is relegated to a substantially flattened condition which can be folded, rolled up or placed on a spindle for ease of transport and rapid deployment at a flood site. Deployment consists of placing the barrier on the anticipated flood site, weighting and fastening the skirts to the ground and inflating the collar. As rising flood water enters the flood chamber it expands said chamber, resulting in an effective flood barrier.

3 Claims, 1 Drawing Sheet

FLOTATION FLOOD WALL

CROSS-REFERENCE TO RELATED APPLICATIONS

This application claims benefit of Provisional application Ser. No. 60/050,148, filed Jun. 18, 1997.

BACKGROUND OF THE INVENTION

Subject invention is a reusable, flexible, easily transportable and substantially self contained flood prevention device which can be deployed by workers with minimal instruction.

BRIEF SUMMARY OF THE INVENTION

Frequent and apparently increasing flood conditions caused by unprecedented rain and rapid snow melts in conjunction with the inability of levies and dikes to contain the increased flow has resulted in the loss of life and extreme damage to property. There are numerous patents for transportable flood control devices, some employing absorption, some employing angular dimensioning, and others using assorted combinations of sheathing, stacking, or reinforcing members and numerous other devices. However, it appears that the sand bag is still the primary, if not the only flood mitigation system commonly used. Obviously, a need exists for a flood control device that incorporates reasonable manufacturing costs, ease of transport, reusability, and especially functional utility all in one. The subject invention utilizes these qualities and also uses the flood water itself to form a flood water barrier.

BRIEF DESCRIPTION OF THE DRAWINGS

In FIG 1., FIG. 2. & FIG. 3. the various components are identified by the same numbers as follows: 2. shows the inflatable flotation collar; 3. shows the expandable flood chamber; 4. shows the support skirt; 5. shows the grommets incorporated into the skirts to facilitate attachment to the ground; 6. shows the flood water entry ports incorporated into the expandable flood chamber, and 7. indicates flood water.

DETAILED DESCRIPTION OF THE INVENTION

Figure 1:
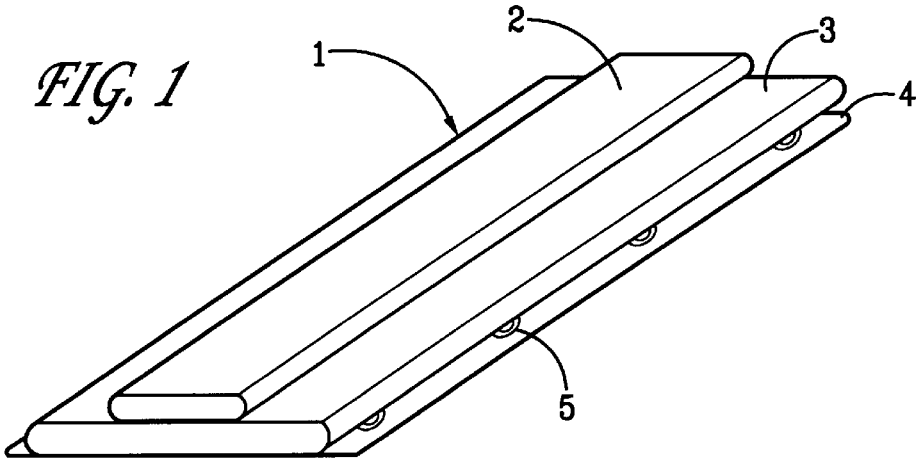
FIG. 1 shows a perspective view of the invention in its deflated and empty state.
Figure 2:
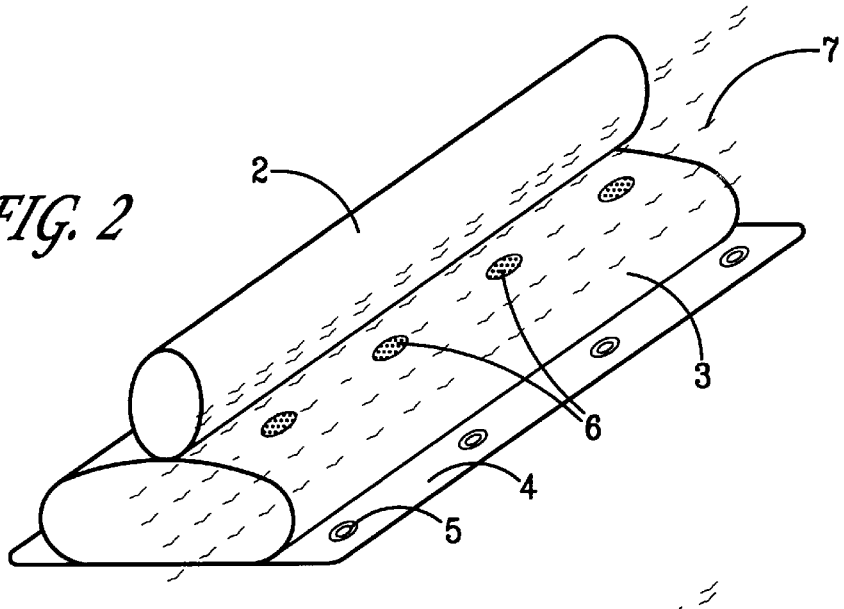
FIG. 2 shows a perspective view of the invention in an inflated state and filled with flood water to approximately 50% capacity.
Figure 3:
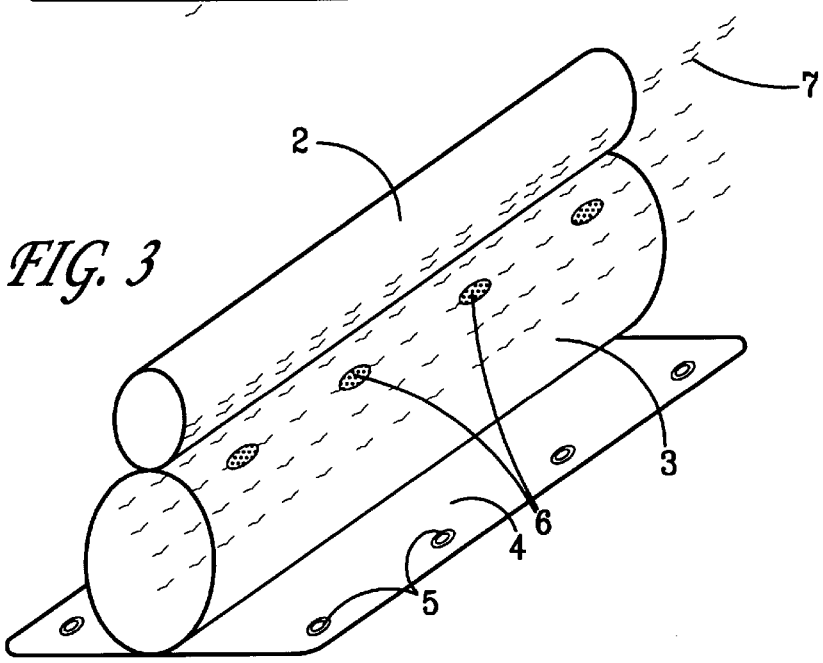
FIG. 3 shows a perspective view of the invention inflated and filled with flood water to approximately 100% capacity.

FIG. 1 shows the Flotation Flood Wall in its deflated mode. FIG. 2 shows its mode at approximately 50% capacity and FIG. 3 in its mode at approximately 100% capacity. In this description of the invention all numbers represented in FIG. 1, FIG. 2 and FIG. 3 identify the various components of the invention by the same numbers. The skirts 4 are affixed to the ground with appropriate fasteners inserted through grommets 5 incorporated into the skirts. When fastened (and, depending on anticipated flood conditions, weighted with sandbags, stones or other suitable weights) the skirts 4 provide a ground seal against the flood water and an anchor for the expandable flood chamber 3. As the flood water 7 rises, it lifts the air-inflated flotation collar 2, allowing flood water 7 to enter the expandable flood chamber 3 through the plurality of entry ports 6, suitably screened to prevent the entry of debris. Thus, the flood chamber in conjunction with the invention's other components provides a formidable flood water barrier.

A key feature of the Flotation Flood Wall is self containment. The invention itself, delivered to a potential flood site either folded, on a spindle or in any other configuration, need only be accompanied by fasteners to secure the skirts 4 to the ground and an air supply to inflate the flotation collar 2. Foot pumps and a variety of compressed air devices can easily be delivered or incorporated into the collar assuming no air source is available on site. A variety of materials can be used to provide additional weight to the skirts if needed. As the actual flood water itself trapped within the expandable flood chamber, is a primary element in the operation of the invention, obviously it does not need to be supplied. Another feature of the invention is its low profile which is maintained during the range of operation. Once flood water 7 reaches the barrier only the flotation collar 2 or a portion thereof is exposed to winds, which are often considerable during flood periods. The material of which the air flotation collar is made is rubber, or a type of synthetic material with air tight qualities and sufficient durability. The expandable flood chamber is constructed of similar material providing water tight integrity, flexibility and / or expansion qualities. Also, the flotation collar 2 and the expandable flood chamber 3 have a segment with pre-formed design to maintain proper storage shape in the deflated and empty condition and facilitate proper shape as filling starts.

The Flotation Flood Wall may be manufactured in a variety of lengths and may incorporate a method of fastening one to another. Additionally, the height range can be increased or decreased by changing the size of the invention's components. The positioning of supports against the dry side should be used if flood and wind conditions dictate or if the Flotation Flood Wall is manufactured of lesser quality materials.

I claim:

1. A transportable flood barrier for use as a dam, dike seawall or the like comprising: a generally rectangular ground sheet made of a flexible, durable, water-tight material and capable of forming a seal against water intrusion when fastened to the ground and properly weighted; and, attached to its upper side, an expandable and collapsible tubular flood chamber extending the approximate length of the ground sheet, said flood chamber made of a flexible, durable water-tight material and fitted on one side with a plurality of ports permitting the flow of flood water in or out, said ports being adequately screened to prevent the entry of debris into the chamber; and attached to the upper portion of the flood chamber, above the ports, a flexible, durable inflatable tubular air chamber extending the approximate length of the flood chamber, which when inflated with air maintains a partial position above the water line, rising and falling as flood water dictates and raising and lowering the flood chamber in consequence; and the entire flood barrier being made of flexible and durable material so that it may be rolled up or folded up for ease of transport and deployment.

2. A flood barrier as described in claim 1, wherein the ground sheet contains a plurality of grommets to provide a means of fastening to the ground.

3. A flood barrier as described in claim 1, wherein supports are placed against the dry side for additional stability.

* * * * *